US006511165B1

(12) United States Patent
Barinaga et al.

(10) Patent No.: US 6,511,165 B1
(45) Date of Patent: Jan. 28, 2003

(54) MANIFOLD INTAKE FOR COUPLING INK SUPPLIES WITH FOAM/FILTER FLUIDIC INTERCONNECTS TO TUBE-BASED PRINTING SYSTEMS

(75) Inventors: Louis C. Barinaga, Salem, OR (US); Mark Hauck, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/975,395

(22) Filed: Oct. 11, 2001

(51) Int. Cl.[7] ..... B41J 2/175
(52) U.S. Cl. ..... 347/85
(58) Field of Search ..... 347/84, 85, 86, 347/87, 28

(56) References Cited

U.S. PATENT DOCUMENTS 5,495,272 A * 2/1996 Yamaguchi ..... 347/28
6,231,173 B1 5/2001 Pawlowski, Jr. et al. ..... 347/86
6,247,802 B1 6/2001 Gasso ..... 347/85
6,250,738 B1 6/2001 Waller et al. ..... 347/42
6,254,229 B1 7/2001 Bohorquez et al. ..... 347/93
6,264,313 B1 7/2001 Mackowiak et al. ..... 347/85
6,299,296 B2 * 10/2001 Gasvoda ..... 347/85

FOREIGN PATENT DOCUMENTS

EP 1048468 A2 * 2/2000 ..... B41J/2/175

* cited by examiner

*Primary Examiner*—Anh T. N. Vo

(57) ABSTRACT

An inkjet ink supply system is disclosed. The supply system has a foam-based fluid supply and a fluidic interconnect. The fluidic interconnect has a tower portion having a chamber therein. The chamber has an opening for interfacing with the foam-based fluid supply and for receiving a fluid, such as ink, from the foam-based fluid supply. The fluidic interconnect also has a fluid outlet portion in communication with the chamber of the tower portion. A tube may be connected to the fluid outlet portion for directing the fluid to a scanning carriage with at least one printhead. In this manner, a foam-based fluid supply may be used in either an on-axis or an off-axis configuration.

11 Claims, 2 Drawing Sheets

MANIFOLD INTAKE FOR COUPLING INK SUPPLIES WITH FOAM/FILTER FLUIDIC INTERCONNECTS TO TUBE-BASED PRINTING SYSTEMS

FIELD OF THE INVENTION

The invention relates to ink supplies for ink jet printers. In particular, the invention relates to a system for coupling ink supplies with foam/filter fluidic interconnects to a tube-based printing system.

BACKGROUND

Ink jet printers typically comprise a printhead assembly which scans the width of a printing medium such as paper. Each printhead typically has several nozzles through which ink is deposited onto the printing medium. Once the printhead assembly scans a section of the printing medium, the printing medium may be advanced so that another section may be scanned by the printhead assembly. Ink may be supplied to the printhead assembly from an ink reservoir in several ways. These ways can generally be divided into two categories. One category is an on-axis delivery system. In an on-axis delivery system, the ink reservoir is generally integral with the printhead assembly and is carried along with the printhead assembly during the scanning process.

The second category of ink delivery systems is referred to as an off-axis delivery system. In an off-axis delivery system, the ink reservoir is maintained in a stationary position relative to the printer chassis. The printhead assembly may obtain ink from the ink reservoir by taking a "sip" from the reservoir between scans of the printing medium. In this way, the printhead assembly is capable of holding just enough ink for a few scans of the printing medium. Alternatively, ink may be supplied to the printhead assembly via a tube system. In this way, the printhead assembly has a constant supply of ink provided through a flexible tubing system connecting the printhead assembly to the ink reservoir while the printhead assembly scans the printing medium.

Some ink supplies employ a foam/filter fluidic interconnect between a foam-based ink supply and the printhead assembly. In such a foam-based ink supply, ink is supplied from an ink supply through a foam/filter arrangement into a fluidic interconnect. The fluidic interconnect may comprise an outlet with a rubber septum. The septum is penetrated by a hollow needle which supplies the ink directly to a printhead.

Such an arrangement for a foam-based ink supply, however, does not provide the flexibility of being used in either an on-axis or an off-axis arrangement. Present systems limit the use of a foam-based ink supply to an on-axis supply system. Accordingly, the ink supply must be carried along with the printhead assembly during the printing or scanning process. This arrangement has the additional drawback of requiring a large "swept volume" of the printer. In other words, since the ink supply must be carried along with the printhead assembly during the scanning process, a larger printer size is necessitated to accommodate the movement of the ink supply.

It is desirable, therefore, to provide a system that allows the use of a foam/filter ink supply in either an on-axis or an off-axis arrangement.

SUMMARY OF THE INVENTION

One embodiment of the invention provides a fluidic interconnect comprising a tower portion having a chamber therein, the chamber having an opening for interfacing with a foam-based ink supply; and a fluid outlet portion in fluidic communication with the chamber, the fluid outlet portion being adapted to accept a tube for directing the fluid out of the chamber.

In a further aspect of the present invention, the fluidic interconnect may further comprise an external seal around the tower portion for preventing leakage to an external environment.

In a further aspect of the present invention, the external seal may comprise a conical member surrounding the tower portion and a spring adapted to urge the conical member against a foam-based ink supply.

In a further aspect of the present invention, the fluid outlet portion may comprise a hollowed cylindrical extension.

In a further aspect of the present invention, the cylindrical extension may comprise at least one barb formed on an external wall for securing a tube onto the cylindrical extension.

Alternatively, the fluidic interconnect may comprise a ferrule and crimp cap for securing a tube to the cylindrical extension.

In a further aspect of the present invention, the fluidic interconnect may further comprise a tube guide for reducing strain on a tube connected to the fluid outlet portion.

According to another embodiment of the invention, an inkjet ink supply system comprises a foam-based fluid supply; a fluidic interconnect comprising a tower portion having a chamber therein, the chamber having an opening for interfacing with the foam-based fluid supply and receiving a fluid from the foam-based fluid supply, and a fluid outlet portion in fluidic communication with the chamber; and a tube in fluid communication with the fluid outlet portion for directing the fluid to a scanning carriage, the carriage comprising at least one printhead.

In a further aspect of the present invention, the fluidic interconnect and the foam-based fluid supply may be adapted to remain stationary as the scanning carriage scans a print region.

In a further aspect of the present invention, the fluidic interconnect may be mounted to a printer chassis.

In a further aspect of the present invention, the tube may be made of a flexible material.

In a further aspect of the present invention, the tube may have a first end connected to the fluid outlet portion of the fluidic interconnect and a second end connected to the scanning carriage.

Alternatively, the fluidic interconnect and the foam-based fluid supply may be adapted to move with the scanning carriage.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

Figure 1:
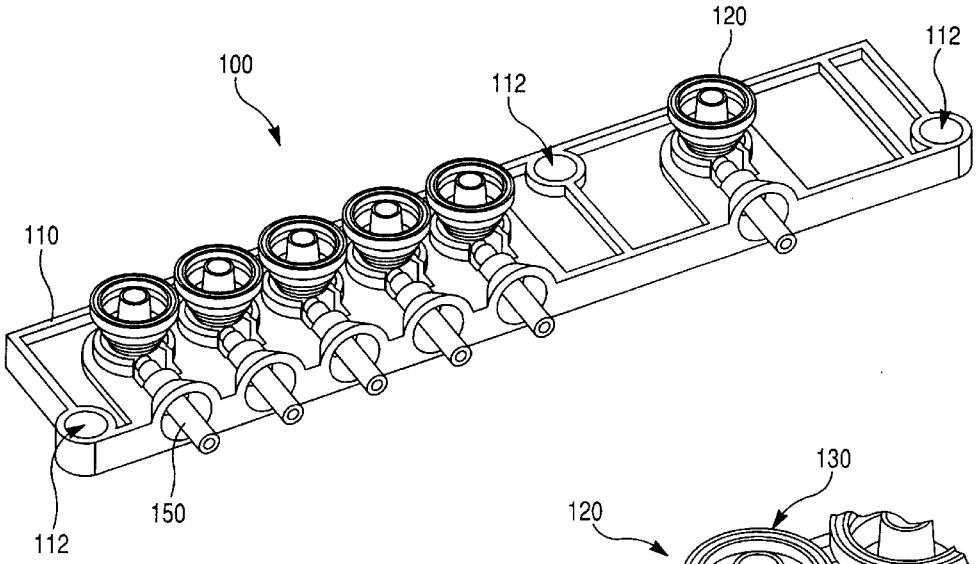
FIG. 1 is a schematic diagram of a fluidic interconnect manifold according to one embodiment of the invention.
Figure 2:
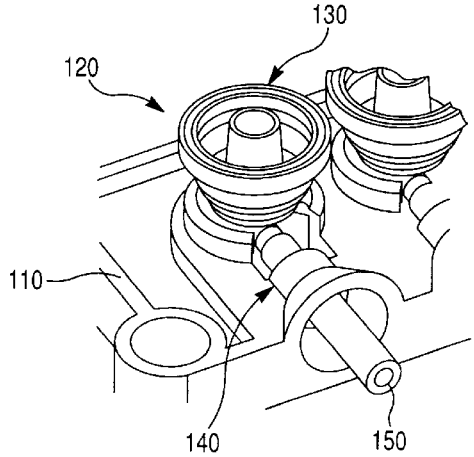
FIG. 2 is a detailed perspective view of a fluidic interconnect according to one embodiment of the invention.
Figure 3:
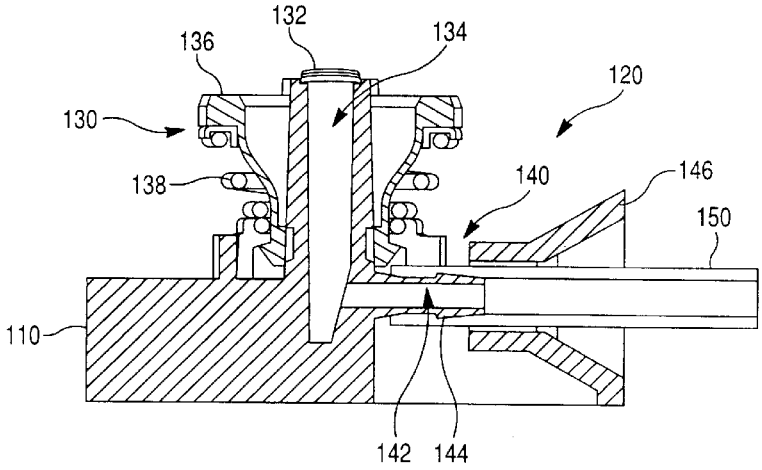
FIG. 3 is a cross-sectional side view of the fluidic interconnect illustrated in FIG. 2.

FIGS. 1 through 3 illustrate a fluidic interconnect system according to one embodiment of the invention. FIG. 1 illustrates a fluidic interconnect manifold 100 comprising a manifold frame 110. The manifold frame 110 may be made out of metal or molded plastic, for example. The manifold frame 110 is provided with mounting holes 112 for mounting the manifold 100 onto a printer chassis or carriage, for example. The manifold 100 is provided with a plurality of fluidic interconnects 120 for supplying a fluid such as printing ink from one or more reservoirs to a printhead. FIGS. 2 and 3 illustrate a fluidic interconnect 120 in greater detail.

Each fluidic interconnect 120 comprises a tower portion 130 and a fluid outlet portion 140. The tower portion 130 is adapted to engage a foam-based ink supply (not shown) at the top of the tower portion 130. A coarse inlet filter 132 is provided at the entry to a fluid chamber 134 in the tower portion 130. The coarse inlet filter 132 allows a bubble pressure to be maintained, thereby preventing ink from being drained out of the ink supply and fluidic interconnect 120 into a print head.

In the sample embodiment illustrated in FIGS. 2 and 3, the fluid chamber 134 is formed by a hollow cylindrical extension of the manifold frame 110. As noted above, at one end of the hollow fluid chamber 134, the coarse inlet filter 132 is provided to interface with the ink supply and a foam-based ink supply assembly. The foam-based ink supply may be mounted to the fluidic interconnect 120 in any conventional manner. The other end of the fluid chamber 134 is in fluidic communication with the fluid outlet portion 140, as described in detail below. The tower portion 130 is also provided with an external seal 136. In the embodiment illustrated in FIGS. 1 through 3, the external seal 136 is formed in an upside down conical configuration. The external seal 136 prevents leakage of ink into the environment external to the fluidic interconnect 120. A compression spring 138 is provided to urge the external seal 136 upward against the foam-based ink supply.

The fluid outlet portion 140 comprises an outlet channel 142 formed by a hollowed cylindrical extension of the manifold frame 110. One end of the outlet channel 142 is in fluidic communication with the fluid chamber 134 of the tower portion 130. Although the outlet channel 142 is illustrated in FIGS. 1 through 3 as being substantially perpendicular to the fluid chamber 134, other configurations are also contemplated.

A barb 144 is formed on the outside wall of the outlet channel 142 for retaining a tube 150. The barb 144 prevents accidental removal of the tube 150, for example. In the embodiment illustrated in FIGS. 1–3, a single barb 144 is illustrated on the fluid outlet portion 140. However, a series of barbs 144 may be provided for a more secure attachment of the tube 150. In other embodiment, the barb 144 may be formed as a bulb to secure the tube 150.

Further, the fluid outlet portion 140 is provided with a tube guide 146. The tube guide 146 serves several purposes. For example, the tube guide assists in inserting the tube 150 onto the outlet channel 142. Additionally, the tube guide provides strain relief for the connection between the tube 150 and the fluid outlet portion 140.

Figure 4:
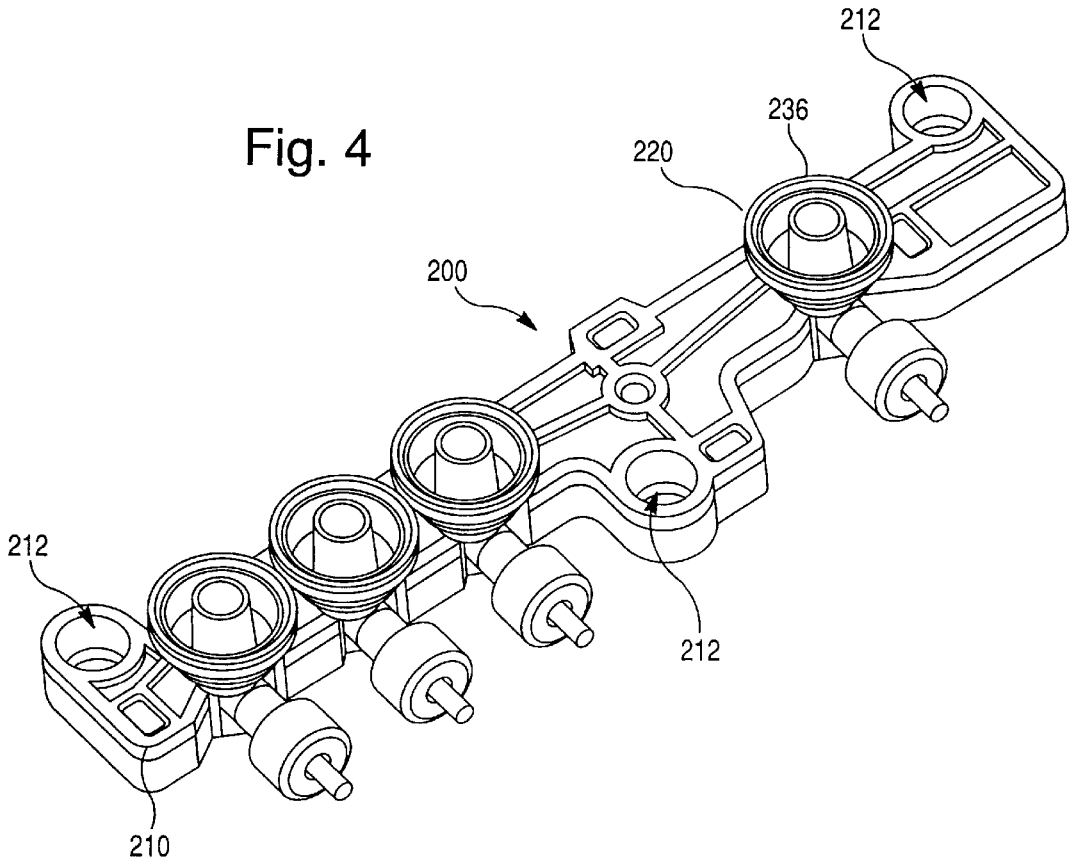
FIG. 4 is a schematic diagram of a fluidic interconnect manifold according to another embodiment of the invention.
Figure 5:
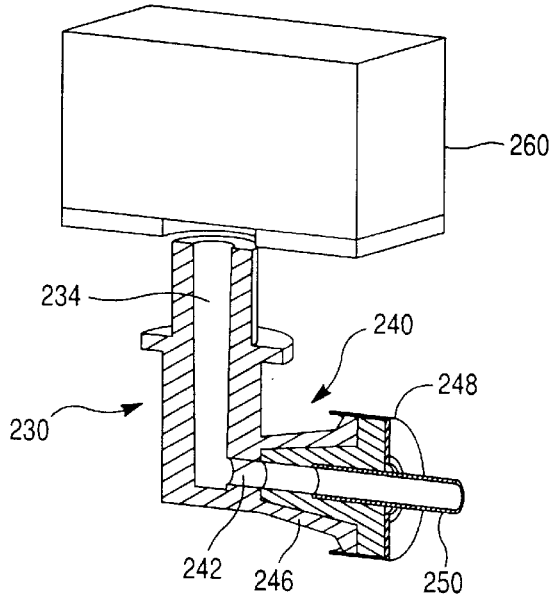
FIG. 5 is a cross-sectional view of a fluidic interconnect illustrated in FIG. 4.

FIGS. 4 and 5 illustrate another embodiment of a fluid interconnect manifold according to the present invention. A manifold 200 comprises a manifold frame 210 provided with mounting holes 212, similar to those described above with reference to FIGS. 1 through 3. The manifold 200 is also provided with fluidic interconnects 220 mounted on the manifold frame 210. In the embodiment illustrated in FIG. 4, a manifold 200 is provided with four fluidic interconnects 220. However, any practical number of fluidic interconnects 220 may be provided on a single manifold 200.

FIG. 5 shows a fluidic interconnect 220 in greater detail. As with the embodiment described above with reference to FIGS. 1 through 3, the embodiment of FIGS. 4 and 5 also comprises a tower portion 230 and a fluid outlet portion 240 in communication with a foam-baased ink supply 260. The tower portion 230 comprises a fluid chamber 234 formed within a hollowed cylindrical extension of the manifold frame 210. An external seal 236 may be provided to prevent ink from leaking to the external environment. The external seal 236 is illustrated in FIG. 4. However, it is not required by the invention and is not shown in FIG. 5.

The fluid outlet portion 240 comprises an outlet channel 242 formed by hollowed cylindrical extension of the manifold frame 210. A tube guide 246 is also formed around the outlet channel 242, similar to that described above with reference to FIGS. 1 through 3. A tube 250 is inserted into a ferrule and crimp cap 248, which in turn in is connected to the outlet channel 242. The ferrule and crimp cap 248 prevent accidental removal of the tube from the outlet channel 242. An opening in the crimp cap 248 allows the tube 250 to be inserted therein. This arrangement is particularly useful for tubes 250 having a smaller inner diameter. For example, a connection between the outlet channel 242 and tubes 250 having an inner diameter of one millimeter or less may be better accomplished using the ferrule and crimp cap arrangement as illustrated in FIGS. 4 and 5.

In operation, the fluidic interconnects 120 illustrated in FIGS. 1–3 interface with a foam-based ink supply and transmit ink through the outlet channel 142. The outlet channels 142 may provide ink to a printhead via the tube 150. In this manner, the foam-based ink supply may be provided as an on-axis or an off-axis system. In an on-axis system, the tube 150 is in a fixed orientation between the fluidic interconnect 120 and an inkjet printhead. Thus, the printhead, tube 150, fluidic interconnect 120, and the ink supply all move in unison with the carriage carrying the printhead.

Alternatively, the fluidic interconnect 120 may be used in an off-axis ink supply configuration as well. In this arrangement, the fluidic interconnect 120 as well as the manifold 100 may be affixed to a position on the printer chassis, for example. A foam-based ink supply may be provided to communicate with the fluidic interconnects 120 in a position that is stationary relative to the printer chassis. Thus, the manifold 100, fluidic interconnects 120, and the ink supply are stationary, but the printhead is carried through a scanning/printing region to a moving printer carriage. Ink may be supplied from the fluidic interconnects 120 to the printhead via a tube system, such as tube 150. As noted above, the tube 150 may be made to be flexible. Thus, as the printhead scans the printing medium, the flexible tube 150 provides fluidic communication between the fluidic interconnect 120 and the printhead.

Thus, the invention allows the use of a foam-based ink supply with either an on-axis or an off-axis arrangement. The invention provides additional flexibility and modularity between ink supplies and printheads.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

What is claimed is:

1. A fluidic interconnect, comprising:

a tower portion having a chamber therein, said chamber having an opening for interfacing it with a foam-based ink supply;

an external seal around said tower portion for preventing leakage to an external environment, the external seal comprising a conical member surrounding said tower portion and a spring adapted to urge said conical member against said foam-based ink supply; and a fluid outlet portion in fluidic communication with said chamber, said fluid outlet portion being adapted to accept a tube for directing said fluid out of said chamber.

2. The fluidic interconnect according to claim 1, wherein said fluid outlet portion comprises a hollowed cylindrical extension.

3. The fluidic interconnect according to claim 2, wherein said cylindrical extension comprises at least one barb formed on an external wall for securing a tube onto said cylindrical extension.

4. The fluidic interconnect according to claim 2, further comprising a ferrule and crimp cap for securing a tube to said cylindrical extension.

5. The fluidic interconnect according to claim 1, further comprising a tube guide for reducing strain on a tube connected to said fluid outlet portion.

6. An inkjet ink supply system, comprising:

a foam-based fluid supply;

a fluidic interconnect, comprising:

a tower portion having a chamber therein, said chamber having an opening for interfacing with said foam-based fluid supply and receiving a fluid from said foam-based fluid supply;

an external seal around said tower portion for preventing leakage to an external environment, the external seal comprising a conical member surrounding said tower portion and a spring adapted to urge said conical member against said foam-based fluid supply; and a fluid outlet portion in fluidic communication with said chamber; and a tube in fluid communication with said fluid outlet portion for directing said fluid to a scanning carriage, said carriage comprising at least one printhead.

7. The inkjet ink supply system according to claim 6, wherein said fluidic interconnect and said foam-based fluid supply are adapted to remain stationary as the scanning carriage scans a print region.

8. The inkjet ink supply system according to claim 7, wherein said fluidic interconnect is mounted to a printer chassis.

9. The inkjet ink supply system according to claim 7, wherein said tube is made of a flexible material.

10. The inkjet ink supply system according to claim 9, wherein said tube has a first end connected to said fluid outlet portion of said fluidic interconnect and a second end connected to said scanning carriage.

11. The inkjet ink supply system according to claim 6, wherein said fluidic interconnect and said foam-based fluid supply are adapted to move with the scanning carriage.

* * * * *